US005294053A

United States Patent [19]

Perret, Jr.

[11] Patent Number: 5,294,053

[45] Date of Patent: Mar. 15, 1994

[54] AIRLESS SPRAY HEAD WITH IMPROVED ORIFICE TIP MOUNTING

[76] Inventor: Robert J. Perret, Jr., 1828 Sequoia St., Orange, Calif. 92668

[21] Appl. No.: 15,232

[22] Filed: Feb. 9, 1993

[51] Int. Cl.[5] ..... B05B 15/02

[52] U.S. Cl. ..... 239/119; 239/288.3

[58] Field of Search ..... 239/119, 288-288.5, 239/390, 391, 393, 397, 442, 600, DIG. 22

[56] References Cited

U.S. PATENT DOCUMENTS

| | | | |
|---|---|---|---|
| 3,593,920 | 7/1971 | Watson | 239/119 |
| 4,074,857 | 2/1978 | Calder | 239/288.3 |
| 4,116,386 | 9/1978 | Calder | 239/119 |
| 4,508,268 | 4/1985 | Geberth, Jr. | 239/119 |
| 4,537,355 | 8/1985 | Calder | 239/288.3 |
| 4,715,537 | 12/1987 | Calder | 239/119 |
| 4,971,249 | 11/1990 | Tam et al. | 239/288.3 |

FOREIGN PATENT DOCUMENTS

| | | | |
|---|---|---|---|
| 887018 | 12/1981 | U.S.S.R. | 239/119 |

*Primary Examiner*—Karen B. Merritt

*Attorney, Agent, or Firm*—Plante Strauss and Vanderburgh

[57] ABSTRACT

There is disclosed a rotatable orifice tip holder for use in airless spraying which has an orifice tip member mounted in a transverse through bore of the holder. The through bore has a major portion of a first, large diameter and a lesser portion of a substantially lesser diameter. The orifice tip member is press fitted into the through bore with its hemispherical head received within the lesser diameter portion of the through bore and a sealing plug is permanently seated, by a press fit into the major portion of the through bore. The sealing plug has a through passageway of a small diameter and a counter bore of greater diameter but lesser length and is oriented in the through bore of the holder with the counter bore adjacent the inlet face of the orifice tip member. The volume of the counterbore is maintained at a minimal volume which provides adequate diffusion of the spray jet during the cleaning operation yet which exhibits minimal frictional pressure loss during spraying. Further, the reduced diameter of the through bore in the spray tip turret member provides a maximum seal area while in the cleaning position, and avoids leaks during the cleaning of the tip.

9 Claims, 3 Drawing Sheets

AIRLESS SPRAY HEAD WITH IMPROVED ORIFICE TIP MOUNTING

BACKGROUND OF THE INVENTION

1. Field of Invention

This invention relates to a spray tip for airless spraying and, in particular, to an improved mounting of an orifice tip in a spray tip head.

2. Brief Statement of the Prior Art

The field of airless spraying and equipment used has been well established over many decades of use. Typically, paints, stains, lacquers, etc., are sprayed at high pressures, usually from 2,000 to 5,000 psi, through a minute orifice having a shape and configuration which imparts a desired spray pattern to the discharge. Because of the abrasive nature of the liquid and the relatively high pressures employed, parts which are subjected to highly abrasive conditions, such as the orifice tip member, are formed of very high wear-resistant material, e.g., tungsten carbide and the like.

The small diameter orifice of the orifice tip member unavoidably clogs during painting and a universal design has been to mount the carbide tip member in a holder which can be rotated to reverse the carbide tip member between spraying and cleaning positions. In this manner, any clogs in the orifice can be blown out with the high pressure liquid supplied to the spray head.

Because the liquid will discharge as a jet under relatively high pressures when blowing clogs out of the orifice, safety concerns have resulted in the design of spray tip heads with spray guards to prevent placing one's finger adjacent the orifice tip. Another innovation which has been used commercially comprises stepping the diameter of the passageway communicating with the orifice tip member to provide a small diameter orifice in the cleaning position. It has been found that this disrupts the liquid stream and causes atomization and dispersion of the liquid. Other techniques which have been used for a similar result include positioning a diffuser pin (see U.S. Pat. No. 4,508,268) or other obstruction to break up a coherent liquid jet and cause the liquid to atomize into a safe, dispersed spray.

A difficulty with the aforementioned techniques is that they create an undesirable frictional pressure loss that decreases the efficiency of the spraying operation. Also some leakage occurs during cleaning operations as the rotatable member has a reduced sealing surface when it is in the cleaning position. As a consequence, most of the spray tip heads will leak or dribble paint when operated in the cleaning position. This is an inconvenience and annoyance to the spray operator.

Another trend in the airless spray industry is to provide rotatable orifice tip holders which can be operated with finger or hand pressure without the use of wrenches or other tools. This tendency has exacerbated the aforementioned sealing problems as leaks cannot be avoided by increasing the compressive pressure on the seals as such increased pressure would seize the holder and prevent its facile rotation.

OBJECTIVES OF THE INVENTION

It is an objective of this invention to provide an improved spray tip head.

It is a further objective of this invention to provide a rotatable holder for an orifice tip member of a spray tip head having improved efficiency.

It is an additional objective of this invention to provide a holder for an airless spray tip head which can be hand turned between spraying and cleaning positions and which is resistant to seal leakage during cleaning and spraying operations.

It is still an additional object of this invention to provide an improved mounting of an orifice tip member in an orifice tip holder.

It is still a further object of this invention to provide an orifice tip head which is safe, easy to rotate between spraying and cleaning positions and which does not leak during use.

BRIEF DESCRIPTION OF THE INVENTION

This invention comprises a rotatable orifice tip holder having an orifice tip member mounted in a transverse through bore of the holder. The through bore has a major portion of a first, large diameter and a lesser portion of a substantially lesser diameter. The orifice tip member is press fitted into the through bore with its hemispherical head received within the lesser diameter portion of the through bore and a sealing plug is permanently seated, by a press fit into the major portion of the through bore. The sealing plug has a through passageway of a small diameter and a counter bore of greater diameter but lesser length and is oriented in the through bore of the holder with the counter bore adjacent the inlet face of the orifice tip member. The volume of the counterbore is maintained at a minimal volume which provides adequate diffusion of the spray jet during the cleaning operation yet which exhibits minimal frictional pressure loss during spraying. Further, the reduced diameter of the through bore in the spray tip turret member provides a maximum seal area while in the cleaning position, and avoids leaks during the cleaning of the tip.

BRIEF DESCRIPTION OF THE DRAWINGS

The invention will now be described with reference to the FIGURES of which.

DESCRIPTION OF PREFERRED EMBODIMENT

Figure 1:
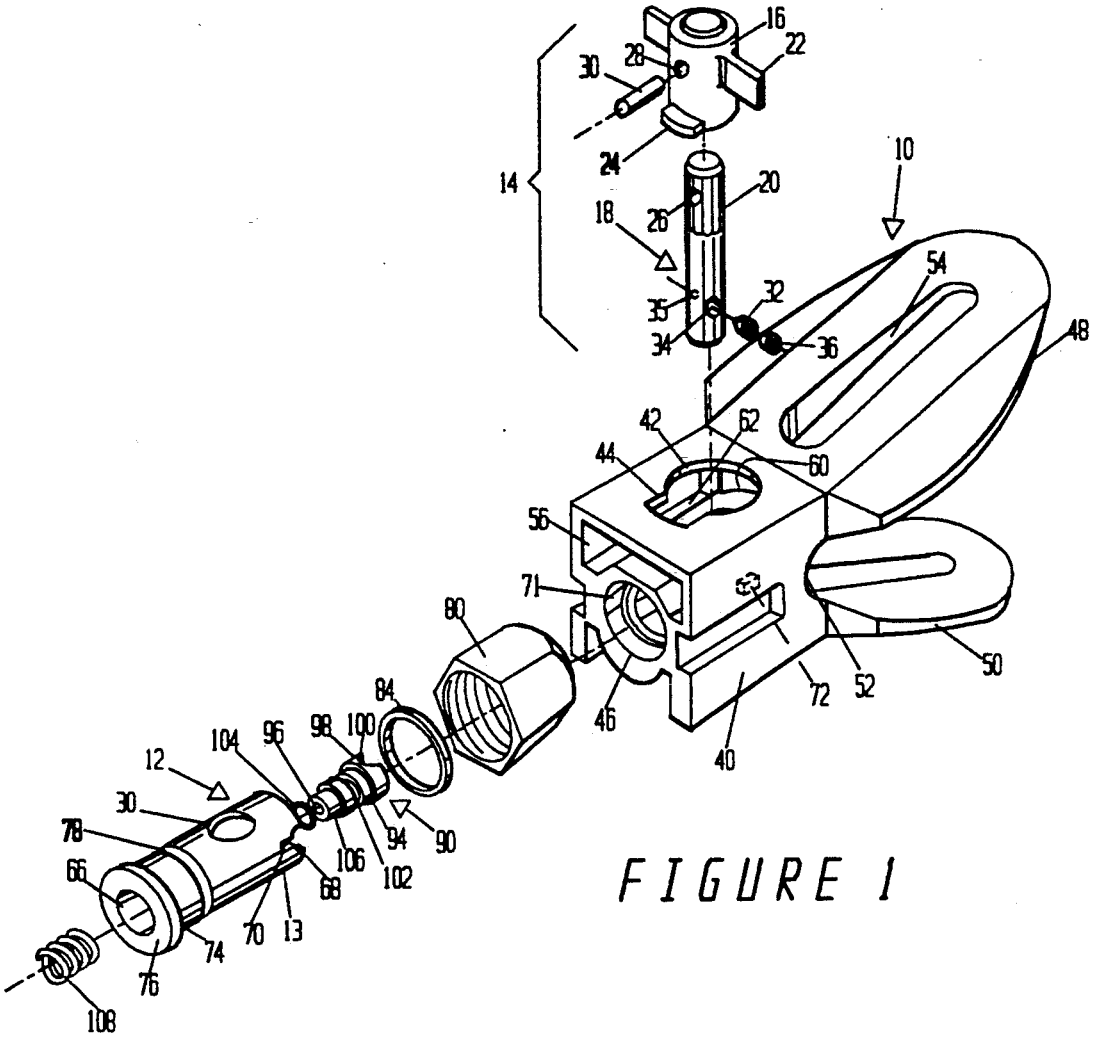
FIG. 1 is an exploded perspective view of the spray tip head.
Figure 2:
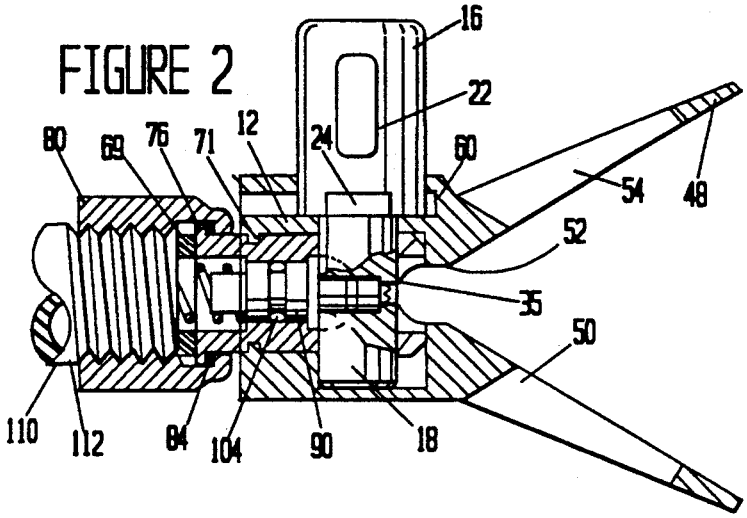
FIG. 2 is an elevational sectional view of a spray tip head used in the invention.

Referring now to FIG. 1, the spray head with which the orifice tip holder of the invention is used is shown. The spray head which is illustrated in FIGS. 1 and 2 is essentially the same as that described in U.S. Pat. No. 4,715,537, and is included herein as the improved subassembly of the orifice tip holder is useful with this spray head.

The spray head includes a spray guard 10 which mounts on a tubular housing 12 that supports a turret subassembly 14. The turret subassembly 14 is formed of a handle 16 which is dependent from cylindrical orifice tip holder 18. The upper end 20 of orifice tip holder 18 preferably is splined, as illustrated, and is press-fitted into a central bore in the underside of handle 16. The handle 16 has a pair of ears 22, and a radial prong 24 at its base. The orifice tip holder is indexed to a precise position in handle 16 by alignment of transverse bore 26 in its upper end 20 with mating bore 28 in the handle, and a roll pin 30 can be used to complete the assembly.

The orifice tip holder 18 carries a spray tip orifice member 32 in a transverse bore 34. Bore 34 is counterbored with a small diameter through bore 35 which receives the hemispherical head of the spray tip orifice member 32, as described hereinafter with reference to FIGS. 3 and 4.

The spray guard 10 has a body 40 with an aperture 42 to receive the base of handle 16. The orifice tip holder assembly 14 has radial prong 24 and aperture 42 has a notch 44 which permits passage of the handle when the latter is rotated to align prong 24 with notch 44.

The spray guard 10 has a central longitudinal, cylindrical cavity 46 that receives the tubular body 13 of the housing 12. At its forward end, the spray guard 10 has a pair of outwardly diverging wings 48 and 50 which are generally trapezoidal.

At the apex or intersection of wings 48 and 50, the spray guard has a slot 52 to provide clearance of the spray discharged from the spray tip. Each of the outwardly diverging wings 48 and 50 has a longitudinal, central, through slot such as 54. As illustrated for the preferred embodiment, the slots are narrow and extend substantially the entire length of wings 48 and 50.

The spray guard body 40 also has an internal cavity 56 superimposed over cavity 46 and this cavity has central aperture 42 to receive the orifice tip holder 18. The end interior wall 60 of cavity 56 has internal shoulders such as 62, which are spaced at opposite sides of the cavity 56. These shoulders serve as limiting stops for the rotation of orifice tip holder, engaging prong 24 and permitting rotation of the orifice tip holder through only 180 degrees of rotation. These rotation-limiting stops are engaged when the orifice tip holder is in either its cleaning or spraying positions, with its transverse bore 34 in alignment with the longitudinal through passageway of the spray tip.

The tubular housing 12 has a longitudinal through passageway 66, and a cylindrical bore 30 orthogonal to and intersecting the longitudinal through passageway 66 and this cylindrical bore 30 receives the cylindrical orifice tip holder 18. At its forward end, the housing 12 has an arcuate slot 68 at each side which has a smaller, longitudinal extension slot 70. The arcuate slot 68 aligns with the slot 52 in the spray guard body 40 and provides clearance for the liquid spray from the orifice 32. The extension slots 70 receive keys 72 on the internal sidewalls of the cavity 46 in the spray guard body 40, thereby keying the spray guard to the housing 12. At its upstream end 74, housing 12 has an annular flange 76, nd an annular groove 78. The annular groove 78 receives a detenting rib 71 which is molded on the inside wall of the spray guard 12, thereby firmly securing the subassembly of housing 12 and spray guard 10.

The spray tip head is retained on the externally threaded barrel of a spray gun by the retainer cap nut 80, and a low frictional characteristic, bearing washer 84 is captured between the annular flange 76 and the retainer nut 80. The washer provides very low frictional resistance between the retainer nut and the housing 12 when the retainer nut 80 is tightened. The central through passageway of the housing body 12 receives the floating piston seal 90.

The floating piston seal 90 comprises a sleeve body 94 with a through bore 96. At its forward end the sleeve body 94 carries turret seal 98. The seal 98 has a cylindrically concave face 100, to mate with the cylindrical contour of orifice tip holder 18. Sleeve body 94 has as annular groove 102 which receives an annular resilient sealing member, preferably an 0-ring 104 to seal the floating piston on the longitudinal through passageway of housing 12. The upstream end of sleeve body 94 has a reduced diameter neck 106 and a compression spring 108 is received over this neck.

Referring now to FIG. 2, the spray tip is shown as assembled to a spray gun 110 by the retainer cap nut 80, which is tightened on to the threaded barrel 112 of the spray gun. The compression spring 108 bears against the end of the spray gun barrel and applies a resilient force to the piston seal 90. In FIG. 2, the forward end of the turret seal 98 is sectioned, to receive the orifice tip holder 18, and this member is also sectional, in part, to reveal the sleeve 36 and the orifice member 34.

FIG. 2 also illustrates seal washer 69 that is formed of a suitable low frictional characteristic plastic, e.g., Teflon, Nylon, etc,,is retained between the end of the spray gun barrel and the flange 26 of housing 12. In applications at low to moderate pressure, e..g. up to about 3000 psig., the combination of this washer and the low frictional characteristic washer 84 provide very low frictional drag resisting the turning of the spray tip when it is assembled onto the end of a spray gun, thereby permitting rotation of the spray pattern without loosening of the retainer nut 80 which secures the spray tip to the spray gun.

Figure 3:
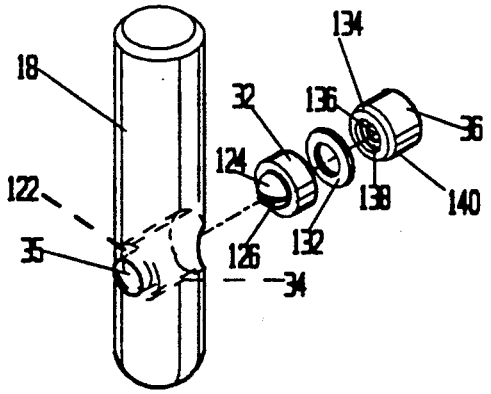
FIG. 3 is an exploded perspective view of the orifice tip holder subassembly.

Referring now to FIG. 3, the subassembly of the spray tip holder, orifice tip and retainer will be described. This subassembly is illustrated in exploded perspective view in FIG. 3 and in elevational sectional view in FIG. 4. As apparent from these illustrations, the orifice tip holder 18 is cylindrical body having a transverse through bore 35 which is counterbored to an enlarged diameter bore 34 to provide an interior annular shoulder 122. This provides a through bore having a major portion (counterbore 34) of a large diameter, and a remaining, small diameter portion (bore 35) of lesser diameter, preferable a diameter from 60 to 75 percent of the diameter of the major portion.

The orifice tip member 32 is a conventional cylindrical member formed of a hard, abrasion resistant material such as tungsten carbide. This member has a discharge face supporting a hemispherical boss 124 that has a V-groove 126 intersecting a minute through passageway 128 (see FIG. 4). The diameter of the hemispherical boss 124 is slightly less than the diameter of the small diameter portion 130 of through bore 35 and the length of the small diameter portion 130 of the transverse bore 35 in the cylindrical body 18 is approximately the same distance as the elevation of the hemispherical tip 124 from its cylindrical body.

The orifice tip member 32 is received in the large diameter counterbore 34 of the transverse bore 35 of orifice tip holder 18 with the hemispherical boss 124 projecting into the small diameter portion 130 of the transverse bore 35.

A sealing washer 132 formed of a resilient, compressible material is received in the counterbore 34, and a cylindrical retainer plug 36 is press fitted into the enlarged diameter counterbore 34 of the through bore 35. Preferably, this plug 36 has a diameter slightly greater than the diameter of the counterbore 34 and has a tapered leading edge 134, preferably tapered at about 5° to facilitate its insertion and press fitting into the counterbore 34.

Figure 4:
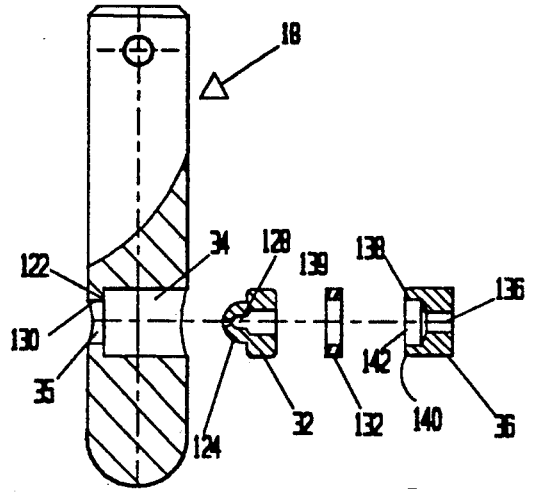
FIG. 4 is an elevational sectional view of the orifice tip holder subassembly.

As shown in FIG. 4, the retainer plug 36 has a through passageway 136 of small diameter, e.g., less than 0.10 inch, preferably less than 0.07 inch and has a larger diameter counterbore 138 at its forward end 140 to form an enlarged diameter cavity 142 of limited volume. The diameter of the through passageway 136 is slightly less, or substantially equal to the diameter of the entrance port 139 of the orifice tip, e.g., from 0.5 to 1.1 times the diameter of the entrance port 139. The diameter of the through passageway 136 is preferably from 25 to 65 percent of the diameter of the bore 35. The diameter of the expansion chamber 138 is 30 to 70% percent, preferably 40 to 60 percent, the diameter of the plug 36. The length of the counterbore 138 is limited and is preferably from 15 to 25% of its diameter and from 10 to 25% of the length of the passageway in the sealing plug, resulting in a volume of the expansion chamber which is from 9 to 50, preferably from 16 to 36 percent the volume of the plug 36. It has been found that the pressure drop experienced when spraying with the orifice tip is thereby minimized, while still retaining adequate dispersion of the liquid during cleaning, with the aforementioned dimensions.

It has been found that the limited volume of the cavity 142 greatly reduces the pressure loss during spraying operations yet, the cavity 142 is entirely effective in disrupting the liquid discharge, and preventing forming of a coherent jet when in the cleaning position.

Figure 5:
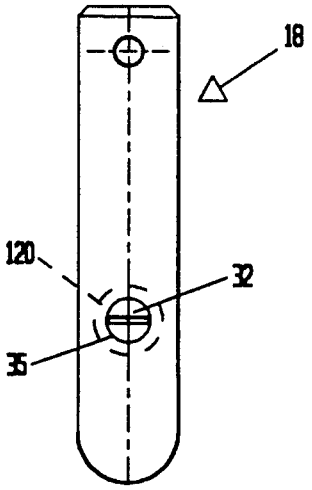
FIG. 5 is a view of the discharge face of the orifice tip holder subassembly.

Referring now to FIG. 5, there is illustrated a view showing the orifice tip member 32 in the spray tip holder 18. As can be seen from this illustration, the through bore 35 which receives the hemispherical boss 124 of the orifice tip 32 is of minimal diameter thus ensuring a maximum seal area 120 on the surface of the orifice tip member 18, surrounded by a broken line. This is the area engaged by the seal face 100 of the seal 90 of the spray head when the holder 18 is rotated into its cleaning position. It has been found that this maximum seal area eliminates the tendency of the spray tip to leak during cleaning.

Figure 6:
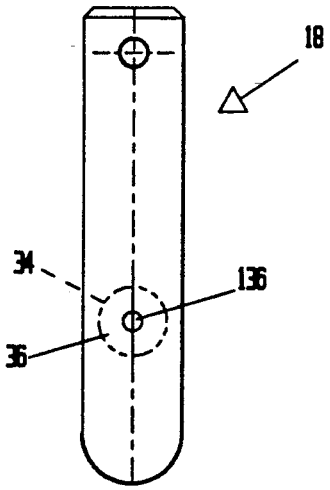
FIG. 6 is a view of the inlet face of the orifice tip holder subassembly.

FIG. 6 illustrates the sealing plug in the spray orifice tip holder. As the sub-assembly is centerless ground after the retainer plug 36 has been press fitted into the holder 18, the intersection between the sealing plug and the cylindrical body is virtually invisible. The outline of this intersection is shown by the broken line in FIG. 6. The only visible discontinuity in the cylindrical surface of the holder 18 is the very small diameter passage 136 in the sealing plug 36.

The invention provides for a simple and efficient subassembly of an orifice tip in an orifice tip holder which provides a maximum sealing surface when the holder is in the cleaning position eliminating leaks. Additionally, the limited volume of expansion chamber within the sealing plug greatly reduces the pressure drop encountered during normal spraying operations, increasing the efficiency of the spray head.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. In a spray tip for airless spraying wherein an orifice tip member is positioned in a holder and said holder is mounted for rotational movement on a axis of rotation within said spray tip between spraying and cleaning positions, the improved subassembly of said holder and spray tip which comprises:

a. a transverse through bore through said holder orthogonal to the axis of rotation, said through bore having a major portion of a first diameter along a major portion of its length and a remaining portion of a second, substantially lesser diameter along the remaining portion of its length;

b. an orifice tip member having a generally cylindrical shape with a diameter closely conforming to said first diameter and an arcuately convex discharge face of a diameter less than said second diameter and received within said transverse through bore with its discharge face extending into said remaining portion; and c. a sealing plug permanently received in said major portion of said through bore of said holder, said plug having a through passage with a small diameter and a counterbore of greater diameter and lesser length, and oriented in said subassembly with said counterbore adjacent to said orifice tip member, with the volume of said counterbore being from 16 to 36% the volume of said plug, whereby the liquid discharged from the orifice tip in its cleaning position is dispersed and the pressure drop through the orifice tip in its spraying position is minimized.

2. The spray tip for airless spraying of claim 1 including a resilient seal washier received between said sealing plug and said orifice tip member.

3. The spray tip for airless spraying of claim 1 wherein said sealing plug is press fitted into said major portion of said through bore of said holder.

4. The spray tip for airless spraying of claim 1 wherein said small diameter of said through passage of said sealing plug has a diameter from 25 to 65 percent the diameter of said second diameter of said through bore of said holder.

5. The spray tip for airless spraying of claim 1 wherein said counterbore has a length from 10 to 25 percent of the length of said through passage.

6. The spray tip of claim 1 wherein said subassembly is finished with center-less grinding.

7. The spray tip for airless spraying of claim 1 wherein said second diameter is b 60 to 75 percent of said first diameter.

8. The spray tip of claim 1 wherein a leading edge of said sealing plug is chamfered at 5 degrees.

9. The spray tip for airless spraying of claim 1 in combination with a spray head which includes:

a. a spray tip housing formed of a housing body having a longitudinal through bore, and a transverse bore orthogonal to said through bore with said subassembly of said holder and spray tip rotationally mounted in said transverse bore; and b. means to secure one end of said housing body to an airless spray gun.

* * * * *